United States Patent [19]

Goloff

[11] 4,338,998

[45] Jul. 13, 1982

[54] LOW PROFILE HEAT EXCHANGER AND METHOD OF MAKING THE SAME

[75] Inventor: Alexander Goloff, East Peoria, Ill.

[73] Assignee: Caterpillar Tractor Co., Peoria, Ill.

[21] Appl. No.: 250,749

[22] PCT Filed: Jul. 7, 1980

[86] PCT No.: PCT/US80/00857

§ 371 Date: Jul. 7, 1980

§ 102(e) Date: Jul. 7, 1980

[87] PCT Pub. No.: WO82/00194

PCT Pub. Date: Jan. 21, 1982

[51] Int. Cl.[3] ..... F28F 9/22; F28F 3/00; F28D 9/00

[52] U.S. Cl. ..... 165/165; 29/157.3 D; 165/DIG. 10

[58] Field of Search ..... 165/165, 166, DIG. 10; 29/157.3 D; 113/118 D, 118 V

[56] References Cited

U.S. PATENT DOCUMENTS

| | | | |
|---|---|---|---|
| 2,321,110 | 6/1943 | Shipman | 165/166 |
| 2,953,110 | 9/1960 | Etheridge | 165/166 X |
| 3,148,442 | 9/1964 | Gier, Jr. | 165/166 X |
| 3,552,488 | 1/1971 | Grill et al. | 165/166 |
| 3,759,323 | 9/1973 | Dawson et al. | 165/166 |
| 3,866,674 | 2/1975 | Tramuta et al. | 165/166 |
| 3,892,119 | 7/1975 | Miller et al. | 72/385 |
| 4,116,271 | 9/1978 | De Lepeleire | 165/166 |

FOREIGN PATENT DOCUMENTS

| | | | |
|---|---|---|---|
| 2514651 | 10/1975 | Fed. Rep. of Germany | 165/165 |
| 1272343 | 12/1961 | France | 165/166 |

*Primary Examiner*—Sheldon J. Richter

*Attorney, Agent, or Firm*—Sixbey, Friedman & Leedom

[57] ABSTRACT

A low profile heat exchanger module (46) and method for forming the same wherein the heat exchanger module (46) is formed from one or more compact, single sheet primary surface heat exchanger core units (38*a* and 38*b*). Each single sheet primary surface core unit (38*a* and 38*b*) is made from a rectangular sheet of a suitable heat exchange material (10) which has been serrated along the longitudinal edges (18) to provide entrance ramps (20) and to minimize flow blockage. Fluid flow is controlled by closures (42, 44) in the ends of alternate flow passages (58, 64) which serve to isolate the fluid in one passage from the fluid in an adjacent passage.

25 Claims, 13 Drawing Figures

FIG. 4.
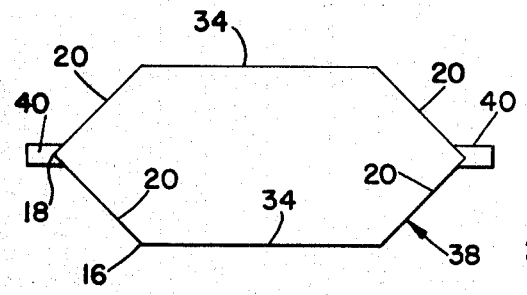
FIG. 5.
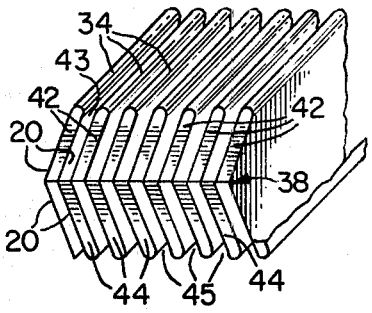
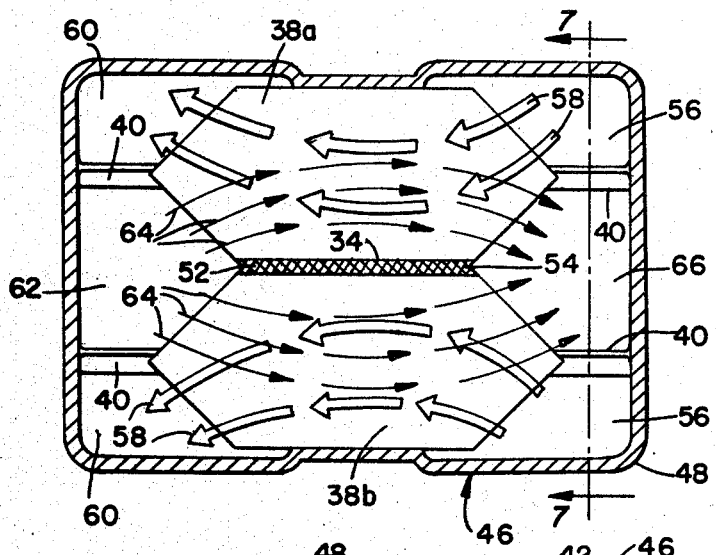
FIG. 6.
FIG. 7.
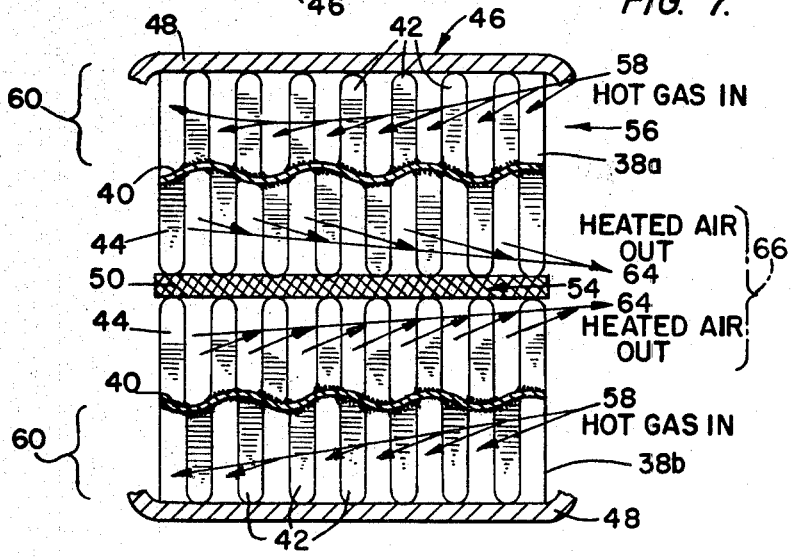

LOW PROFILE HEAT EXCHANGER AND METHOD OF MAKING THE SAME

DESCRIPTION

TECHNICAL FIELD

This invention relates to a low profile heat exchanger module for use in heat furnaces, steel melting furnaces, gas turbines which use recuperators and the like, and a method for forming the same.

BACKGROUND ART

U.S. Pat. No. 3,759,323 issued to Harry J. Dawson et al describes an important prior art primary surface heat exchanger for use as a recuperator core of a gas turbine. Dawson et al discloses a heat exchanger core made from a multiplicity of thin metal sheets which have been individually corrugated, or folded in a wavy pattern according to the method described in U.S. Pat. No. 3,892,119 issued to Miller et al. A large number of these metal plates are stacked on top of each other and the edges of the sheets are crushed to form the flat sections necessary to encase the assembly and to allow the attachment of suitable manifolding for conveying hot and cold fluids. The necessity for crushing the edges results in blockage, and hence the restriction of fluid flow. In addition, the depth of the corrugations in the unit described by Dawson et al is limited by the need to crush the edges. Deep corrugations or pleats cannot be crushed in an organized or predictable manner without causing severe blockage.

The pattern of the corrugations and the relatively thick crushed edges of the individual sheets described by Dawson et al result in rigidity in all directions in the heat exchanger unit. This may lead to the development of high thermal strains, especially when transient loads are characterized by steep gradients.

A major drawback of the prior art heat exchanger construction has been the presence of high stress concentration factors which have resulted from the need to crush the edges. In some applications the effect has been that of producing a multiplicity of cracks. Another problem has been the failure of the weld to penetrate at certain junctions, which results in a preformed crack. While such stress concentration factors may not be significant when the assembly is preloaded in compression, as intended, and when the transients are not steep, high stresses which lead to premature failures may appear under severe operating conditions and after prolonged periods of operation during which the preload is likely to be relaxed.

DISCLOSURE OF THE INVENTION

The present invention is directed to a low profile heat exchanger module made from one or more compact, single sheet primary surface heat exchanger core units. Each unit is formed from a single sheet of thin material which has been pleated to any depth desired. Before pleating, the longitudinal edges of the thin sheet are serrated to provide fluid entrance ramps that minimize blockage, and the surface of the sheet is embossed to define flow passages and provide a means for directing flow and controlling turbulence.

Other objects, advantages and features of the invention will be more readily apparent from the following detailed description of a preferred embodiment of the invention when taken together with the accompanying drawings.

BRIEF DESCRIPTION OF THE DRAWINGS

FIG. 2' is a plan view of a portion of the single sheet of FIG. 1 after embossing to show a "Z" flow concept.

FIG. 4 is a diagrammatic illustration of a side view of a pleated assembly of the present invention;

FIG. 5 is a diagrammatic illustration of an end view of a pleated assembly of the present invention;

FIG. 6 is a cross sectional view of the heat exchanger module of the present invention;

FIG. 7 is a diagrammatic illustration of an end view of the heat exchanger of the present invention;

BEST MODE FOR CARRYING OUT THE INVENTION

Figure 1:
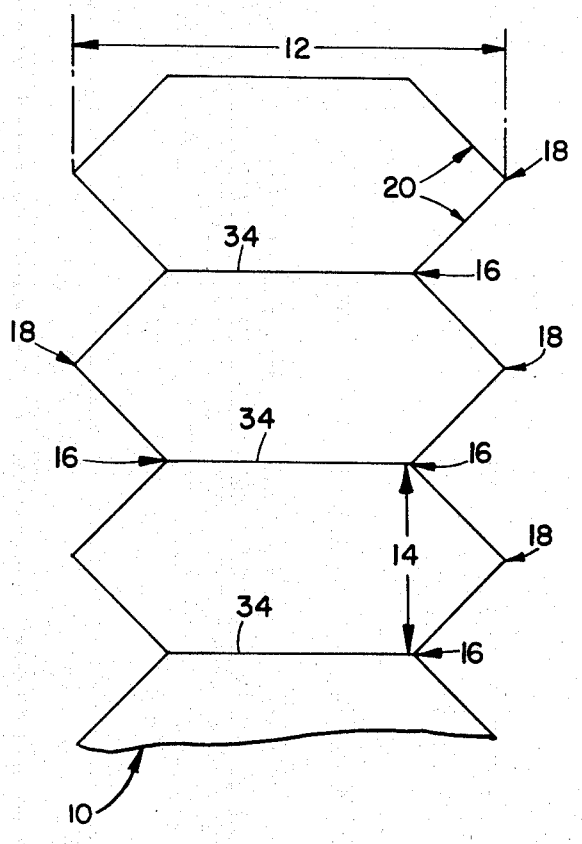
FIG. 1 is a plan view of a portion of a single sheet of heat exchange material employed to form the heat exchange core of the present invention.

FIG. 1 illustrates a single sheet used to form one of the pleated assemblies of the heat exchanger module of the present invention. The single sheet, indicated generally at 10, is a long rectangular strip of heat exchange material, for example of suitable thin metal, such as heat resistant steel. The width of the sheet 10 indicated at 12 determines the length of the resulting pleated assembly, and may be varied by the designer to fit the desired heat exchanger application. The longitudinal edges of the sheet are serrated or cut in a sawtooth pattern so that the distance 14 between notches 16 is about equal to the desired height of the pleated assembly. The apexes or points of the serrated edge are shown at 18, and the distance of an edge 20 extending between notch 16 and point 18 should preferably be equal to the height of the pleated assembly as indicated at 14 to eliminate fluid flow blockage. For example, the assembly may be about 1–2 inches in height at 14 and the width 12 may be about 6–7 inches.

Obviously, the configuration of the serrated edges of the sheet 10 can be altered to meet varying structural requirements. For example, the apexes 18 may be rounded instead of pointed, and the edge 20 can be curved rather than straight.

Figure 3:
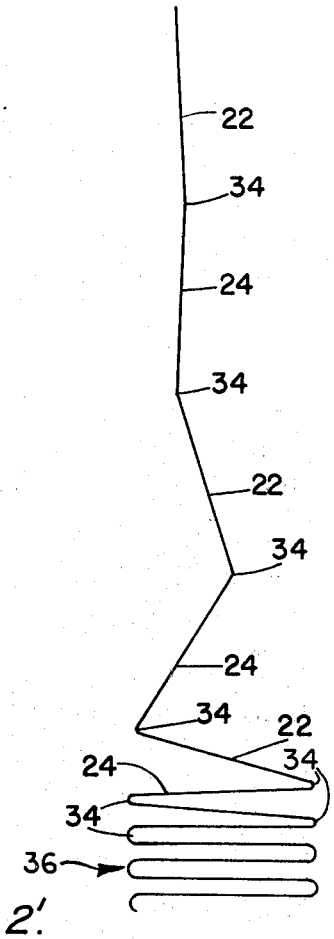
FIG. 3 is a view in side elevation of the single sheet of FIG. 2 during the pleating thereof.
Figure 2:
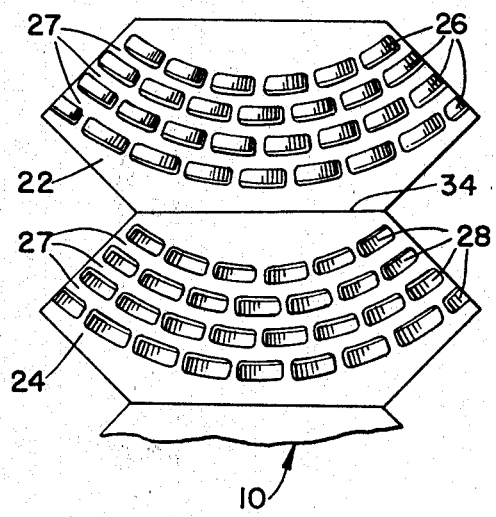
FIG. 2 is a plan view of a portion of the single sheet of FIG. 1 after embossing to show a "U" flow concept.
Figure 2:
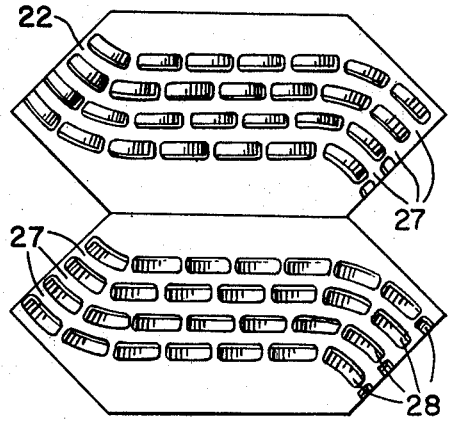

The pleated assembly is formed in a manner depicted in FIGS. 2 and 3 or 2' and 3. The serrated sheet of heat exchange material 10 is divided into sections or walls 22 and 24 which are embossed by means of conventional dies, shaped rollers or any other embossing techniques. The embossing serves to separate the subsequently formed pleats of the heat exchanger accurately and to guide the fluid flow through the completed heat exchanger. The embossing may space the pleats for a distance of about 0.030 inches.

As illustrated in FIGS. 2 and 2', each section 22 and 24 may be embossed in a U-shaped or Z-shaped configuration respectively as shown by the rows of bosses 26 on section 22 and the rows of bosses 28 on section 24. While only four rows of bosses 26 and four rows of bosses 28 are shown, the number of rows could be much higher and is limited only by the size of the sections 22 and 24. Fluid flow channels 27 are defined on the face of each section 22 and 24 between the rows of bosses 26 and 28. The interruptions between bosses in a row induce fluid turbulence in the flow path defined thereby and thus enhance the heat transfer characteristics of the pleated assembly formed from the sheet 10.

Since the sheet 10 will be pleated into a pleated assembly which forms part of the core of the heat exchanger module depicted in FIG. 6, it is necessary to emboss the sheet so that the pleats are spaced far enough apart to allow fluid flow between them. This is accomplished by embossing sections 22 and 24 in opposite directions. Thus in FIG. 2, the bosses 26 on section 22 project upwardly, while the bosses 28 on section 24 project downwardly. This alternate arrangement is maintained throughout the length of the sheet 10.

Once the sheet 10 is embossed, the sheet is pleated by folding it along lines or crest portions 34 between the sections or walls 22 and 24. Pleating may be accomplished mechanically in any conventional manner, such as on machines utilizing dull-edged knife blades like those used for pleating filter paper in the manufacture of air cleaners and oil filters, but which have been modified to pleat thin metal or heat exchange material rather than paper. FIG. 3 shows the embossed sheet 10 being pleated and compressed at the lower end 36 to form the pleated assembly shown in FIG. 4. The sections 22 and 24 of the sheet are compressed together until the raised bosses 26 and 28 contact the next adjacent section of the sheet. Thus the height of such bosses accurately controls the spacing between adjacent sections when the sheet 10 is pleated and compressed. To enable the bosses to perform this spacing function, it is imperative that the bosses on adjacent sections 22 and 24 be precluded from nesting when the sections are compressed together. This may be accomplished, as illustrated in FIG. 2, by placing the bosses on section 24 so that they fall in the spaces between the bosses on section 22 when the two sections are pleated. In addition, the bosses may be of different depths, and it is possible to have both deep and shallow bosses on the same sheet.

When sheet 10 is pleated and compressed as at 36 in FIG. 3, a side view of the pleated assembly would appear as illustrated in FIG. 4, but without items 40 in which the pleated assembly is indicated generally as 38. The embossing is omitted for clarity, but in actuality the fluid flow paths are defined by the bosses previously described. Inclined fluid entrance ramps are formed by edges 20, between notches 16 and points 18, and the pleated assembly is in part held together by means of corrugated strips 40 which are welded to points 18 across each end of the assembly. This is shown in FIG. 5, which depicts an end view of the pleated assembly, not showing the corrugated strip 40. The pleated assembly is also held together by welds 42 and 44 which plug one side of the open ends of the fluid passages between sections 22 and 24, leaving the remaining sides 43 and 45 open. The passages are plugged at both ends, although only one end is shown in FIG. 5. Additional external clamping may be provided to preload the heat exchanger pleats.

The junction of points 18 and welds 42 and 44 creates a relatively inelastic, rigid assembly. However, if such an inelastic area is attached to a relatively elastic area, high thermal stresses cannot be generated. Since the corrugated strip permits limited flexibility along the overall width of the edge 39' which is distant from the weld zone and provides flexibility, and therefore high thermal stresses are substantially eliminated.

It will be noted with reference to FIG. 5, that the welds 42 above the corrugated strip 40 are staggered with relation to the welds 44 below the strip. Thus fluid entry to every other fluid passage occurs above the strip while fluid entry to the intermediate fluid passages occurs below the strip. However, since the edges 20 bordering the entry to a fluid passage form an inclined ramp having a length equal to the total height of the pleated assembly, unrestricted fluid flow into each passage is assured.

The heat exchanger module 46 of the present invention may be formed by stacking at least two pleated assemblies 38 within a housing 48 as shown in FIG. 6. The upper pleated assembly 38*a* is placed over the lower pleated assembly 38*b* with a spacer 50 between them. The spacer 50 is essentially either a solid sheet or a mesh or perforated strip and is shown extending along the entire length of line 34 between sections of the pleated assemblies from point 52 to point 54. However, the spacer 50 may be placed so that it stops short of points 52 and 54. It is possible, by varying the thickness and the length of the spacer 50, to reduce fluid flow blockage beyond the reduction achieved by means of the fluid entry ramps defined by edges 20. As previously mentioned in discussing FIG. 1, the length of edges 20 should be equal to pleat depth 14 to minimize fluid flow blockage. Although the ramps are shown to be straight, longer ramps may be achieved within the same dimensions by curving edges 20, thus lengthening the ramps while maintaining the compactness of the unit.

Hot and cold fluid manifolds are attached to the ends of the two stacked pleated assemblies as shown in FIG. 6, and result in a low profile heat exchanger. Inlet manifolds 56 provide hot fluid, for example hot exhaust gas from a gas turbine, through fluid passages 58. This hot fluid follows the path shown by the white arrows 58 to outlet manifolds 60 which collect the previously hot fluid after heat has been transferred therefrom in the heat exchanger core. Since the heat exchanger of the present invention is a counterflow type heat exchanger, cool fluid, as, for example air from the compressor of a gas turbine engine, is supplied to the path shown by arrows 64 by a cool fluid inlet manifold 62. This cool fluid flows through the pleated assemblies 38*a* and 38*b* along the paths indicated by the dark arrows, is heated, and then is collected by an outlet manifold 66.

The corrugated strips 40 are preferably welded to the housing 48 to form the manifolding. The width of corrugated strip 40 introduces a desired flexibility into the heat exchanger unit, as it allows the reduction of stresses in the presence of thermal gradients. It is also possible, but less desirable, to weld rigid manifolding directly to the pleated assemblies, which is not shown in FIG. 6. However, this means of attaching the manifolding to the pleated assembly does not provide the flexibility and consequent dissipation of thermal stresses possible with the arrangement shown in FIG. 6.

FIG. 7 illustrates an end view of the heat exchanger module 46 used as a recuperator for receiving hot exhaust gas and compressed air from a gas turbine engine. Hot gas input manifolds 56 are at the top and bottom and the hot combustion air output manifold 66 is in the center. Hot gas flows in alternate passages 58 while air to be heated flows in the opposite direction through the intermediate passages 64. The housing 48 closes the open ends of the passages 58.

Figure 8:
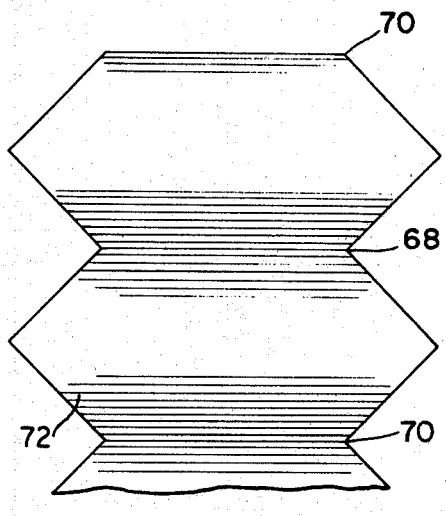
FIG. 8 is a plan view of a portion of a single sheet of heat exchange material of a second embodiment of the present invention.
Figure 9:
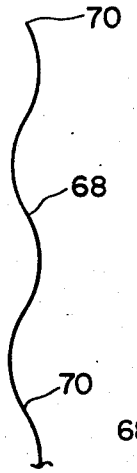
FIG. 9 is a view in side elevation of the single sheet of the embodiment of FIG. 8.
Figure 10:
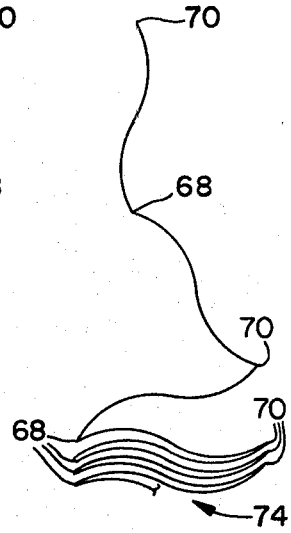
FIG. 10 is a view in side elevation of the single sheet of the embodiment of FIG. 8 during pleating thereof.

A second embodiment of the present invention is diagrammatically shown in FIGS. 8, 9, and 10. Heat exchanger sheet material 72, which has been serrated along the longitudinal edges in the same manner as sheet 10 in FIG. 1 and subsequently embossed, is bent between points 68 and 70 by passing it over shaped rollers, which are not shown in FIG. 8, prior to pleating to form a sheet which is rippled in cross section (FIG. 9). This structure provides flexibility to the pleats in the direction 68–70. FIG. 10, which corresponds to FIG. 3, shows the rippled sheet 72 being pleated and compressed into a bent pleated assembly 74. The method depicted in FIGS. 8, 9, and 10 results in increased flexibility, not only in the pleats themselves, but also in the welded plugs 42 and 44 used to seal alternate flow passages as shown in FIGS. 5 and 7.

Figure 11:
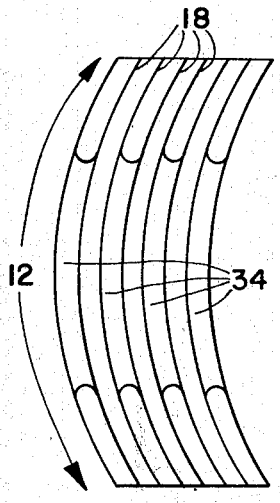
FIG. 11 is a diagrammatic illustration of a third embodiment of the present invention.

Additional flexibility in the direction of sheet width 12 shown in FIG. 1 can be introduced in still another embodiment of the present invention. The compressed pleated assembly shown at 36 in FIG. 3 can be made to assume an arcuate shape or even an "S" shape, (not shown) when viewed in the direction of the crest portions or edges 34, as depicted in FIG. 11.

Figure 12:
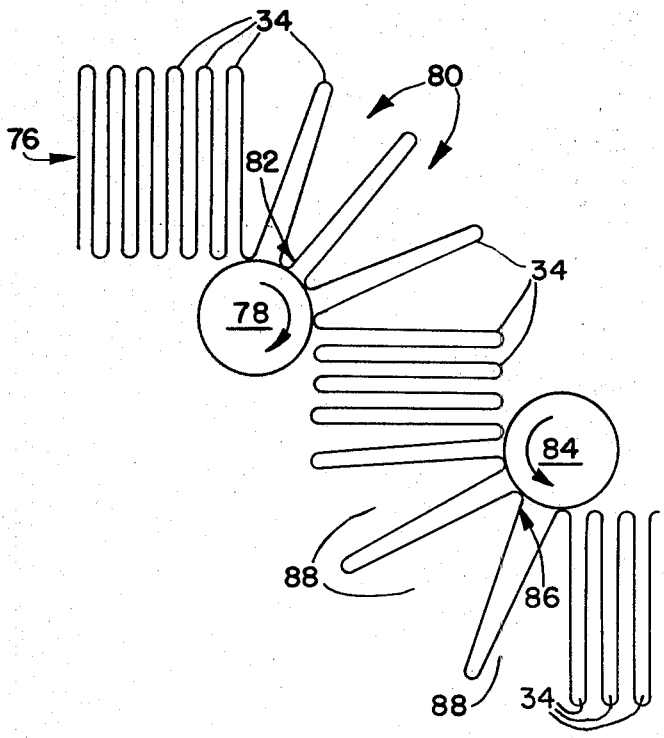
FIG. 12 is a diagrammatic illustration of the method of producing the embodiment of FIG. 11.

Finally, the sheet 10 can be treated in an alternate method after pleating to enhance fluid flow and flexibility. This is accomplished as shown in FIG. 12. A pleated and compressed sheet, indicated generally at 76, is passed over a roller 78, which causes the pleats to separate as at 80 while remaining compressed at 82, thus allowing cams, rollers, pawls, or other suitable mechanisms to be introduced into the wide gaps at 80 to spread the pleats at edge 34 to any desired distance. After passing over roller 78, the pleated and compressed sheet passes over roller 84 where the wide gaps 80 become compressed at 86 and the pleats which were compressed at 82 become separated at 88, thus permitting the same type of cams, rollers or pawls to bow the pleats as at 34, resulting in a compact and bowed, pleated assembly after the core passes over the roller 84 as shown in FIG. 11. This introduces flexibility in the direction of the width of the strip thus minimizing thermal stresses.

Industrial Applicability

The heat exchanger module 46 may be effectively employed as a recuperator for a gas turbine engine or for other heat exchange applications, as, for example, in steel heat treating or melting furnaces. The inlet manifold 62 is connected to a source of cool fluid to be heated while the inlet manifolds 56 are connected to a source of heated fluid. In a gas turbine engine, the inlet manifolds 56 would be connected to receive hot exhaust gases from the engine while the inlet manifold 62 would be connected to receive compressor discharge air from the engine. As the cooler discharge air passes through the pleated assemblies **38*a* and 38*b* with the counter flowing hot exhaust gas, the air is heated by the heat transfer provided by heat exchange sections 22 and 24. The exhaust gas then passes out of the outlet manifolds 60 and is normally vented to the atmosphere while the heated air passes to the outlet manifold 66**. This outlet manifold is connected to the combustor of the gas turbine engine and proceeds on through the engine in the conventional manner.

Other aspects, objects and advantages of this invention can be obtained from a study of the drawings, the disclosure, and the appended claims.

I claim:

1. A primary surface heat exchanger (46) comprising:

(a) at least one heat exchange core **(38*a*) formed from a unitary strip of heat conducting material pleated to define a plurality of sequential sections (22,24) of substantially equal size, adjacent sections (22,24) forming two sidewalls joined at one edge to define a plurality of sequentially arranged, substantially parallel, open ended fluid passages (58,64) extending therethrough, each said fluid passages (58,64) opening along one side of said heat exchange core (38*a*) in a direction opposite to that of the next adjacent fluid passages on either side thereof, one side of each open end of every other one of said fluid passages being closed (44) to form a first group of fluid passages (58) having adjacent aligned closed portions (44) and open portions (43) at either end thereof, the remaining fluid passages (64) intermediate said first group of fluid passages (58) having one side of each open end thereof closed (42) to provide adjacent aligned closed (42) and open portions (45) at the ends thereof, the open portions (43) of said first group of fluid passages (58) being adjacent and intermediate the closed portions (42) of said second group of fluid passages (64), said sections (22,24) being formed to provide undulations in the sidewalls formed thereby extending between the ends of said fluid passages (58,64), (b) first fluid inlet means (56) extending across the open portions (43) of said first group of fluid passages (58) and the closed portions (42) of said second group of fluid passages (64) at a first end of said heat exchange core (38*a*), (c) first fluid outlet means (60) positioned at a second end of said heat exchange core (38*a*) opposite to said first fluid inlet means (56) and extending across the open portions (43) of said first group of fluid passages (58) and the closed portions (42) of said second group of fluid passages (64) at said second end, said first fluid inlet and outlet means (56,60) communicating with said first group of fluid passages (58), (d) second fluid inlet means (62) extending across the open portions (45) of said second group of fluid passages (64) and the closed portions (44) of said first group of fluid passages (58) at said second end of said heat exchanger core (38*a*), (e) second fluid outlet means (66) positioned at the first end of said heat exchanger core (38*a*) opposite to said second fluid inlet means (62) and extending across the open portions (45) of said second group of fluid passages (64) and the closed portions (44) of said first group of fluid passages (58), said second inlet and outlet means (62,66) communicating with said second group of fluid passages (64); and (f) a strip (40) attached to said sequential sections (22,24) extending across at least one end of said heat exchange core (38*a*) between the closed and open sides (42,43,44,45)** of said fluid passages (58,64), said strip (40) being corrugated to provide flexibility lengthwise thereof.

2. The primary surface heat exchanger (46) according to claim 1 wherein said sections (22, 24) are arcuate in cross section to define substantially curved fluid passages (58, 64) in said heat exchange core (38*a*).

3. A primary surface heat exchanger (46) comprising:

(a) at least a first heat exchange core (38*a*), (b) a second heat exchange core (38*b*), (c) each such that exchange core including a plurality of interleaved, substantially parallel fluid passages (58,64) formed by a unitary strip of heat conducting material (10) pleated to define a plurality of sequential sections (22,24) of substantially equal size, adjacent sections (22,24) forming two sidewalls joined at one edge (34) to define an open ended fluid passages (58,64), each such fluid passage opening along one side of said heat exchange core (38*a*, 38*b*) in a direction opposite to that of the next adjacent fluid passages on either side thereof, the fluid passages opening along one side of said heat exchange core in a first direction forming a first group of fluid passages (58) and the intermediate fluid passages opening along an opposite side of said heat exchange core in a second direction opposite to said first direction forming a second group of fluid passages (64), (d) said first group of fluid passages (58) having a first portion of each open end thereof closed (44), said second group of said fluid passages (64) having a second portion of each open end thereof closed (42), said second portion (42) being opposite to said first portion (44) whereby the remaining open portions (43) at the ends of said first group of fluid passages (58) are opposite to the remaining open portions (45) at the ends of said second group of fluid passages (64), (e) said first and second heat exchange cores (38*a*, 38*b*) being relatively positioned so that the portions (45) thereof along which said second group of fluid passages (64) open are adjacent and in alignment and so that the edges (34) of said first heat exchange core (38*a*) are aligned with the edges (34) of said second heat exchange core (38*b*) and spaced apart therefrom to allow separator means (50) to be positioned between the edges (34) of said first heat exchange core (38*a*) and the edges (34) of said second heat exchange core (38*b*), said separator means (50) being formed to permit fluid flow between the second group of fluid passages (64) in said first heat exchange core (38*a*) and the second group of fluid passages (64) in said second heat exchange core (38*b*), (f) closure means (48) secured to said first and second heat exchange cores (38*a*, 38*b*) to close the remaining open sides of said first group of fluid passages (58) along one side of each said first and second heat exchange cores (38*a*, 38*b*), (g) first fluid inlet means (56) extending across the open portions (43) of said first group of fluid passages (58) at a first end of said heat exchange cores (38*a*, 38*b*), (h) first fluid outlet means (60) positioned at a second end of said heat exchange cores (38*a*, 38*b*) opposite to said first fluid inlet means (56) and extending across the open portions (43) of said first group of fluid passages (58) and the closed portions (42) of said second group of fluid passages (64) at said second end, (i) second fluid inlet means (62) extending across the open portions (45) of the second group of fluid passages (64) and the closed portions (44) of the first group of fluid passages (58) at the second end of said first and second heat exchange cores (38*a*, 38*b*), and (j) second fluid outlet means (66) positioned at the end of said heat exchange cores (38*a*, 38*b*) opposite to said second fluid inlet means (62) and extending across the open portions (45) of said second group of fluid passages (64) and the closed portions (44) of said first group of fluid passages (58).

4. The primary surface heat exchanger (46) according to claim 3 including means (26, 28) extending between adjacent pleated sections (22, 24) define fluid flow channels (27) in said fluid passages (58, 64), the fluid flow channels (27) in said first group of fluid passages (58) extending between the open portions (43) at the ends of said first group of fluid passages and the fluid flow channels (27) in said second group of fluid passages (64) extending between the open portions (45) at the ends of said second group of fluid passages.

5. The primary surface heat exchanger (46) according to claim 4 wherein said means (26, 28) extending between adjacent pleated sections (22, 24) is formed to create turbulence in fluid flowing through said fluid flow channels 27.

6. The primary surface heat exchanger (46) according to claim 4 wherein said first and second fluid inlet and outlet means (56, 60, 62, 66) provide fluid flow in opposite directions through said first and second groups of fluid passages (58, 64).

7. The primary surface heat exchanger (46) according to claim 4 wherein said means (26, 28) extending between adjacent pleated sections are elongated bosses on said sequential sections (22, 24).

8. The primary surface heat exchanger (46) according to claim 7 wherein said elongated bosses (26, 28) are formed on only one side of every one of said sequential sections (22, 24), the bosses on adjacent sections (22, 24) extending from opposite sides thereof.

9. The primary surface heat exchanger (46) according to claim 8 wherein the bosses (26, 28) on adjacent sections (22, 24) are misaligned to prevent nesting of said sections.

10. The primary surface heat exchanger (46) of claim 3 wherein said fluid inlet means (56) includes a first fluid inlet manifold (56) connected to a first end of said first heat exchange core (38*a*) and a second fluid inlet manifold (56) connected to a corresponding first end of said second heat exchanger core (38*b*), said first fluid outlet means (60) includes a first fluid outlet manifold (60) connected to a second end of said first heat exchange core (38*a*) and a second fluid outlet manifold (60) connected to a corresponding second end of said second heat exchange core (38*b*), said second fluid inlet means (62) includes a third single fluid inlet manifold (62) connected to the second ends of said first and second heat exchange cores (38*a*, 38*b*) between said first and second fluid outlet manifolds (60), and said second fluid outlet means (66) includes a third single fluid outlet manifold (66) connected to the first ends of said first and second heat exchange cores (38*a*, 38*b*) between said first and second fluid inlet manifolds (56).

11. The primary surface heat exchanger (46) according to claim 10 wherein said first and second fluid inlet and outlet means includes a housing (48) spaced from and enclosing opposite ends of said first and second heat exchange cores (38*a*, 38*b*), said first and second heat exchange cores (38*a*, 38*b*) each including a strip (40) which is attached to said sequential sections (22, 24) and extends across the ends of such heat exchange core (38*a*, 38*b*) between the closed and open portions (42, 43, 44, 45) of said first and second groups of fluid passages (58, 64), said strips (40) extending outwardly from the ends of said first and second heat exchange cores (38*a*, 38*b*) and being attached to said housing (48) to divide the interior of said housing into said first, second, and third fluid inlet and outlet manifolds (56, 62, 60, 66).

12. The primary surface heat exchanger (46) according to claim 11 wherein said strip (40) is corrugated to provide flexibility lengthwise thereof.

13. The primary surface heat exchanger (46) of claim 3 wherein the ends 20 of the sections (22, 24) of each heat exchange core (38*a*, 38*b*) are formed to provide an inclined open side (43, 45) at either end of said fluid passages (58, 64), the length of said open sides (43, 45) being substantially equal to the height of said passages.

14. A method for forming a primary surface heat exchanger (46) which includes:

(a) dividing an elongated unitary strip of heat conducting material (10) into a plurality of sequential sections (22,24) of substantially equal size and cutting said unitary strip of heat conducting material (10) along each side thereof to a sawtooth configuration to provide an apex (18) at each end of each sequential section (22,24) at the center of said section and an edge (20) inclined away from either side of said apex (18) to a point (16) at the dividing line (34) between sections, (b) pleating said elongated strip (10) along the dividing lines (34) between sections (22,24) to form a plurality of interleaved, substantially parallel fluid passages (58,64), the open side of each such fluid passage opening in a direction opposite to that of the next adjacent fluid passages on either side thereof, (c) closing one portion (44) of each open end of every other one of said fluid passages (58) to form a first group of fluid passages (58) having adjacent, aligned closed portions (44) and open portions (43) at either end thereof, and (d) closing one portion (42) of each open end of the remaining intermediate fluid passages (64) which is opposite to the closed portion (44) of said first group of fluid passages (58) to form a second group of fluid passages (64) having adjacent aligned closed portions (42) and open portions (45), the open portions (43,45) of each group of fluid passages being adjacent the closed portions (42,44) of the remaining group of fluid passages to form a first heat exchange core (38*a*), (e) forming an elongated corrugated strip (40) and securing said strip across each end of said unitary strip (10) after the pleating thereof, said strip (40) being secured to the apex (18) of each of said sequential sections (22, 24), (f) repeating steps (a), (b), (c), (d), and (e) above to form a second heat exchange core 38(*b*), (g) positioning said first heat exchange core (38*a*) relative to said second heat exchange core (38*b*) so that the dividing lines (34) of said first core (38*a*) are aligned with the dividing lines of said second core (38*b*) and the open portions (45) of said second group of fluid passages (64) of said first core (38*a*) are adjacent to and in alignment with the open portions (45) of said second group of fluid passages of said second core (38*b*), (h) forming separator means (50) in a manner to permit the flow of fluid therethrough having an axial length substantially equal to the length of said dividing line (34), (i) inserting said separator means (50) between said first and second heat exchange cores (38*a*,38*b*) so that said separator means (50) contacts the dividing lines (34) thereof and fluid flows through said separator means between the second group of fluid passages (64) of said first core (38*a*) and the second group of fluid passages (64) of said second core (38*b*), (j) forming a first fluid inlet means (56) at a first end of said heat exchanger and first fluid outlet means (60) at a second end of said heat exchanger opposite said first end and second fluid inlet means (62) at said second end of said heat exchanger and second fluid outlet means (66) at said first end of said heat exchanger.

15. The method for forming a primary surface heat exchanger according to claim 14 which includes forming said inclined edges (20) to be at least substantially equal in length to the distance (14) across a section (22,24) between the dividing lines (34) with the adjacent sections on either side thereof.

16. The method of claim 14 which includes closing the ends of each fluid passage in said first group of fluid passages (58) along the inclined edges (20) extending in a first direction away from said apex (18) and closing the ends of each fluid passage in said second group of fluid passages (64) along the inclined edges (20) extending in a second direction away from said apex (18), said second direction being opposite to said first direction.

17. The method for forming a primary surface heat exchanger according to claim 14 which includes bending said unitary strip (10) into an arcuate configuration after pleating to cause said sequential sections (22, 24) to be arcuate in cross section along a line extending between the dividing lines (34) between said sections.

18. The method for forming a primary surface heat exchanger according to claim 14 which includes forming undulations extending across said unitary strip (10) between the side edges thereof prior to pleating such strip (10).

19. The method of forming a primary surface heat exchanger (46) according to claim 30 wherein means (26,28) extending between adjacent pleated sections (22,24) is formed to define fluid flow channels (27) in said fluid passages (58,64), the fluid flow channels (27) in said first group of fluid passsages (58) extending between the open portions (43) at the ends of said first group of fluid passages and the fluid flow channels (27) in said second group of fluid passages (64) extending between the open portions (45) at the ends of said second group of fluid passages.

20. The method of forming a primary surface heat exchanger (46) according to claim 19 wherein said means (26,28) extending between adjacent pleated sections (22,24) is formed to create turbulence in fluid flowing through said fluid flow channels 27.

21. The method of forming a primary surface heat exchanger (46) according to claim 20 wherein said first and second fluid inlet and outlet means (56,60,62,66)

provide fluid flow in opposite directions through said first and second groups of fluid passages (58,64).

22. The method of forming a primary surface heat exchanger (46) according to claim 19 wherein said means (26,28) extending between adjacent pleated sections are elongated bosses on said sequential sections (22,24).

23. The method of forming a primary surface heat exchanger (46) according to claim 22 wherein said elongated bosses (26,28) are formed on only one side of every one of said sequential sections (22,24), the bosses on adjacent sections (22,24) extending from opposite sides thereof.

24. The method of forming a primary surface heat exchanger (46) according to claim 23 wherein the bosses (26,28) on adjacent sections (22,24) are misaligned to prevent nesting of said sections.

25. A method for making a heat exchanger core unit (38) which includes:

(a) forming a plurality of serrations (16) in the edge of a strip (10) of material, (b) pleating the strip (10) between each of the serrations (16) to form a pleated and compressed sheet 76 having a plurality of crest portions (34) and a plurality of alternating fluid flow passages (58,64), (c) passing one edge of said pleated and compressed sheet (76) over first roller means (78) so that said crest portions (34) contact said first roller means (78) causing the pleats along said one edge of said sheet (76) adjacent said roller means (78) to remain compressed (82) and the pleats along a second edge of said sheet opposite said roller means (78) to separate, (d) introducing spacing means between said separated pleats (80) to space said pleats apart a desired distance, (e) passing said second edge of said pleated and compressed sheet (76) having said separated pleats (80) over a second roller means (84), causing said separated pleats (80) to become compressed (86) and said compressed pleats (82) to become separated (88), (f) introducing spacing means between said separated pleats (88) to space said pleats (88) apart a desired distance to form a compact and bowed pleated assembly, (g) closing off a portion (42,44) at opposite ends of each said flow passage (58,64) in a repetitive alternating pattern, the closures (42,44) of adjacent flow passages (58,64) extending from the crest portion (34) of each said flow passage toward each other.

* * * * *